US008928257B2

(12) United States Patent
Numazaki

(10) Patent No.: US 8,928,257 B2
(45) Date of Patent: Jan. 6, 2015

(54) LIGHTING CONTROL DEVICE

(71) Applicant: Denso Wave Incorporated, Chita-gun (JP)

(72) Inventor: Yoshihisa Numazaki, Kariya (JP)

(73) Assignee: Denso Wave Incorporated, Aichi-pref (JP)

( * ) Notice: Subject to any disclaimer, the term of this patent is extended or adjusted under 35 U.S.C. 154(b) by 0 days.

(21) Appl. No.: 14/031,542

(22) Filed: Sep. 19, 2013

(65) Prior Publication Data

US 2014/0252993 A1 Sep. 11, 2014

(30) Foreign Application Priority Data

Mar. 6, 2013 (JP) ..... 2013-044047

(51) Int. Cl.
*H05B 37/02* (2006.01)

(52) U.S. Cl.
CPC ..... *H05B 37/0227* (2013.01)
USPC ..... 315/309; 315/209 R

(58) Field of Classification Search
USPC ..... 315/209 R, 225, 291, 307–309, 360, 362
See application file for complete search history.

(56) References Cited

U.S. PATENT DOCUMENTS 5,949,073 A 9/1999 Shimoyama
8,078,318 B2 * 12/2011 Kumazawa et al. ..... 700/245

FOREIGN PATENT DOCUMENTS

JP A-9-297054 11/1997

* cited by examiner

*Primary Examiner* — Jimmy Vu
(74) *Attorney, Agent, or Firm* — Oliff PLC

(57) ABSTRACT

A lighting control device controls a turn-on state and a turn-off state of a lighting apparatus in a room where an air-conditioning apparatus is provided. In the lighting control device, a temperature sensing section is provided in the air-conditioning apparatus and senses temperature of the room to allow the air-conditioning apparatus to perform air-conditioning control such that the sensed temperature of the room lies within a preset temperature range. A temperature acquisition section acquires the sensed temperature. A determination section determines that a switching condition for switching the lighting apparatus has been met, when the acquired sensed temperature coincides, within a preset tolerance range, with a criterion temperature which is set separately from the preset temperature range on the basis of a body temperature of a person. A switching section switches the lighting apparatus between the turn-on state and the turn-off state, when determined that the switching condition has been met.

12 Claims, 5 Drawing Sheets

LIGHTING CONTROL DEVICE

CROSS-REFERENCE TO RELATED APPLICATION

This application is based upon and claims the benefit of priority from Japanese patent application No. 2013-044047, filed on Mar. 6, 2013, the disclosure of which is incorporated herein in its entirety by reference.

BACKGROUND

1. Technical Field

The present invention relates to a lighting control device that controls the turn-on state and the turn-off state of a lighting apparatus provided in a room.

2. Related Art

When an air-conditioning apparatus and a lighting apparatus are provided in a room, the operation of these apparatuses is inputted from the individual separate operating means. Specifically, the air-conditioning apparatus is provided with a control panel that includes a switch for instructing activation/deactivation of the apparatus and a temperature sensor for acquiring the room temperature. Also, the lighting apparatus is provided with a switch for switching the state thereof from a turn-off state to a turn-on state, or vice versa. Therefore, generally, two or more operating means are arranged such as on a wall of a room.

If these operating means are integrated into a single operating means, the integrated operating means can be arranged at a position at which the user can more easily manipulate the operating means and thus the usability may be enhanced. Further, the integrated operating means can contribute to reducing the number of parts arranged on a wall. Accordingly, the integrated operating means may easily harmonize with the interior design of the room and achieve a high satisfaction level of the user. In this case, since a control panel is essential such as to setting a temperature, it is more practical to provide a switch for the lighting apparatus in the control panel.

However, simply integrating the switch of the lighting apparatus with the control panel may increase the size of the control panel, leading to suppressing the enhancement of usability and the harmonization with the interior design of the room as mentioned above.

As a measure against this in the related art, for example, the temperature sensing means of the air-conditioning apparatus may be replaced by a sensing element having multiple functions, as disclosed in JP-A-H09-297054. However, in this case, the cost incurred in producing the parts may be increased. In addition, in this case, it is required to configure and add logic such as detecting a person. Since such detection logic is not used in the related art, construction and addition of the detection logic will increase processing loads of the control panel.

SUMMARY

The present disclosure provides a lighting control device which is able to enhance the usability and easily harmonize with the interior design of a room, without greatly increasing the cost and the loads of the device.

According to the present disclosure, there is provided a lighting control device for controlling a turn-on state and a turn-off state of a lighting apparatus provided in a room in which an air-conditioning apparatus is provided. The lighting control device includes temperature sensing means, temperature acquisition means, determination means and switching means. The temperature sensing means is provided in the air-conditioning apparatus and senses temperature of the room to allow the air-conditioning apparatus to perform air-conditioning control such that the temperature of the room sensed by the temperature sensing means lies within a preset temperature range. The temperature acquisition means acquires, as a sensed temperature, the temperature sensed by the temperature sensing means. The determination means determines that a switching condition for switching the lighting apparatus between a turn-on state and a turn-off state has been met, when the sensed temperature acquired by temperature acquisition means coincides within a preset tolerance range, with a criterion temperature which is set separately from the preset temperature range, on the basis of a body temperature of a person. The switching means switches the lighting apparatus between the turn-on state and the turn-off state, when the determination means determines that the switching condition has been met.

According to the present disclosure, a temperature sensed by a temperature sensing means of an air-conditioning apparatus is acquired as a sensed temperature. When the sensed temperature coincides with a criterion temperature, which is set on the basis of a body temperature of a person, within a predetermined tolerance range, it is determined that a switching condition has been met for changing a state of a lighting apparatus from a turn-off state to a turn-on state, or vice versa. Thus, with this determination, the state of the lighting apparatus changes from a turn-off state to a turn-on state, or vice versa.

The operation for switching the state of the lighting apparatus from a turn-off state to a turn-on state, or vice versa (hereinafter this operation is referred to as "switching operation") is performed by a person. Accordingly, in order to determine whether the switching operation has been performed, it is only required to detect that some operation has been performed by a person. Specifically, in order to detect the switching operation, the body temperature of a person may be used as a reference for making a determination on the switching operation. For this purpose, the determination on whether the switching conditions have been met is made on the basis of the temperature sensed by the temperature sensing means which has conventionally been included in the air-conditioning apparatus.

With this configuration, the switching operation can be determined as having been performed, without the necessity of adding a new configuration for the determination. Further, sensing of a temperature by the temperature sensing means and determination as to whether sensed temperature coincides with a set temperature are what has been performed conventionally. Accordingly, it is not necessary to construct or add new logic for determining whether the switching operation has been performed.

The lighting control device is able to change the state of the lighting apparatus from a turn-off state to a turn-on state, or vice versa, using the configuration based on the related art, without the necessity of constructing or adding a new sensing element, sensing logic or the like. In other words, usability is enhanced without greatly increasing the cost and loads of the device. In addition, the lighting control device can easily harmonize with the interior design of the room.

In the present disclosure, the temperature detecting means may be formed such that the further a sensing area is from the temperature sensing means the more the sensing area expands. Being required to sense the temperature of the room to perform air-conditioning control, the temperature sensing means is ensured to sense the temperature of an opposite side of the room. On the other hand, if the temperature sensing means has sensed the temperature of a person positioned such as in an opposite side of the room, which is away from the temperature sensing means, there is a concern that the lighting control device will erroneously determine that the switching operation has been performed.

In this regard, the temperature sensing means is formed such that the further a sensing area is from the temperature sensing means the more the sensing area expands. Thus, a situation of entirely interrupting the sensing area is created only when a person is positioned near the temperature sensing means. In other words, it is only when a person is positioned near the temperature sensing means that the temperature sensed by the temperature sensing means coincides with the criterion temperature. Thus, a person positioned away from the temperature sensing means will not trigger a determination that the switching operation has been performed, thereby preventing an erroneous determination that the switching operation has been performed.

In the present disclosure, the temperature sensing means may include a plurality of infrared temperature sensors having a sensing area. The more the sensing area departs from the sensors, the more the sensing area expands. The infrared temperature sensors are ensured to be arranged so as to have a different sensing area. When all of individual sensed temperatures, i.e. the temperatures sensed by the plurality of infrared temperature sensors, coincide with the criterion temperature, it is determined that the switching conditions have been met.

In the temperature sensing means, the plurality of infrared temperature sensors are juxtaposed like a so-called sensor array and ensured to sense the temperatures of different sensing areas. In this case, the sensing area of each infrared temperature sensor is made smaller than the entire sensing area of the temperature sensing means. Accordingly, under the condition where the temperature sensed by only one infrared temperature sensor coincides with the criterion temperature, a person can be present at a position away from the temperature sensing means. In such a case, it is unlikely that the person is performing the switching operation.

In this regard, the present disclosure may have the switching condition that all of the individual sensed temperatures sensed by the plurality of infrared temperature sensors coincide with the criterion temperature. The more the sensing areas of the infrared temperature sensors expand, the more they depart from the sensors. Thus, it is only when a person is positioned near the temperature sensing means that all of the individual sensed temperatures sensed by the infrared temperature sensors coincide with the criterion temperature. Accordingly, in making a determination as to whether the switching operation has been performed, an erroneous determination is prevented from being made.

In the present disclosure, the criterion temperature may be set on the basis of the temperature of an exposed portion of a person. Since a person wears clothing, there is a probability that the temperature of the torso of the person, for example, may be sensed to be lower than a body temperature of a person. Therefore, the temperature of a portion of a person exposed from clothing, such as the face or the hand, may be used for setting the criterion temperature to enable correct determination as to whether a person has conducted the switching operation. In this case, the temperature of an exposed portion of a person is considered to be about 35° C. to 36° C.

On the other hand, the temperature of a room that can be set to the air-conditioning apparatus (set temperature) is generally about 30° C. at most. Thus, there is a large difference between the temperature of the exposed portion of a person and the set temperature of the air-conditioning apparatus. In this way, when the criterion temperature is set on the basis of the temperature of an exposed portion of a person, there will be a large difference between the temperature of a room and the criterion temperature. Thus, the probability of making an erroneous determination can be reduced.

In this case, when a person is going to operate a lighting apparatus, the person will generally put his/her hand over the lighting control device. Accordingly, when the temperature of an exposed portion of a person is used as the criterion temperature, it may be determined that the palm, for example, of a person has been put over the lighting control device. In other words, setting the criterion temperature on the basis of the temperature of an exposed portion of a person can corroborate that the switching operation has been performed. Thus, the degree of certainty is reliably enhanced in making a determination as to whether the switching operation has been performed.

In the present disclosure, a view angle $\alpha$ of the temperature sensing means, a person's thickness L1 and a person's width L2 and a distance L3 from the temperature sensing means to a person may satisfy a relation as expressed by the following formula:

$$\alpha > 2 \times \tan^{-1}((L2/2)/(L3+L1/2))$$

In performing the switching operation, a person is considered to be positioned near the lighting control device (i.e. near the temperature sensing means) in order to take an action such as of putting his/her hand over the lighting control device. Conversely, when a person is positioned away from the lighting control device, the person is considered not to be performing the switching operation. Here, the distance at which no switching operation is considered to be performed is L3. If in no situation can a person interrupt the view angle $\alpha$ of the temperature sensing means at the distance L3, an erroneous determination may be prevented from being made. Accordingly, by establishing a relation in which the view angle $\alpha$ of the temperature sensing means satisfies the above formula, the sensing area will not be interrupted by a person if the person is in the position of the distance L3. Thus, in making a determination on whether the switching operation has been performed, an erroneous determination is prevented from being made.

DESCRIPTION OF EMBODIMENTS

Hereinafter, an embodiment of the present invention is described with reference to FIGS. 1 to 7.

Figure 1:
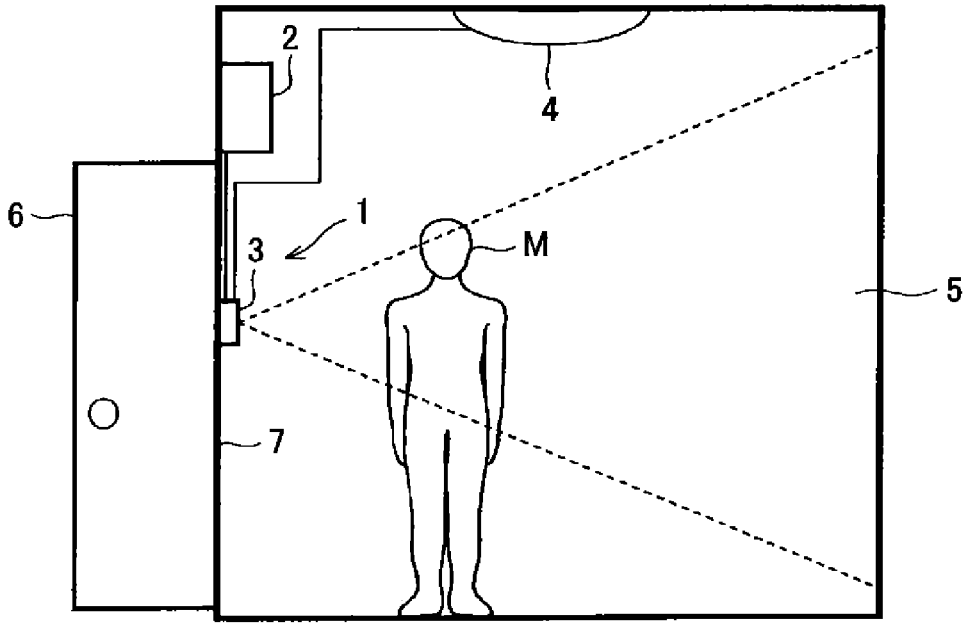
FIG. 1 is a side view illustrating an example of a room in which a lighting control device is provided, according to an embodiment of the present invention.
Figure 2:
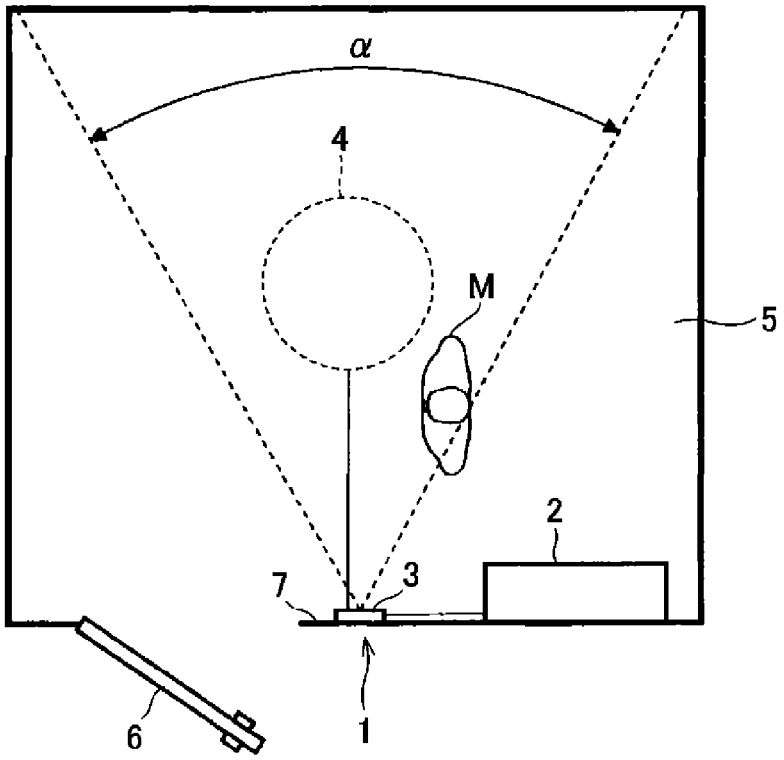
FIG. 2 is a plan view of the room in which the lighting control device is provided.

As shown in FIGS. 1 and 2, a lighting control device 1 of the present embodiment is configured by a control panel (operation panel) 3 included in an air conditioner body (air-conditioning apparatus) 2 that configures an air-conditioning apparatus. In other words, in the present embodiment, the control panel 3 of the air-conditioning apparatus is also used as the lighting control device 1 for controlling a turn-on state and a turn-off state of a lighting apparatus 4. The control panel 3 as the lighting control device 1 is arranged near a door-way of a room 5. More specifically, the control panel 3 is arranged on a wall 7, being positioned at a level at which a person M can manipulate the control panel 3 by hand when opening or closing a door 6. In the present embodiment, the air-conditioning apparatus performs so-called around-the-clock air conditioning, such that the temperature of the room 5 falls within a preset temperature range.

The lighting control device 1 performs switching control to switch the state of the lighting apparatus 4 between a turn-on state and a turn-off state. This control will be specifically described later. The lighting control device 1 switches the state of the lighting apparatus 4 from a turn-off state to a turn-on state, or vice versa, by determining whether or not an operation for such switching (switching operation) has been performed. The lighting control device 1 is connected to the lighting apparatus 4 which is provided such as on the ceiling of the room 5. Actually, a wiring that connects between the lighting control device 1 and the lighting apparatus 4 is provided inside the wall 7.

Figure 3:
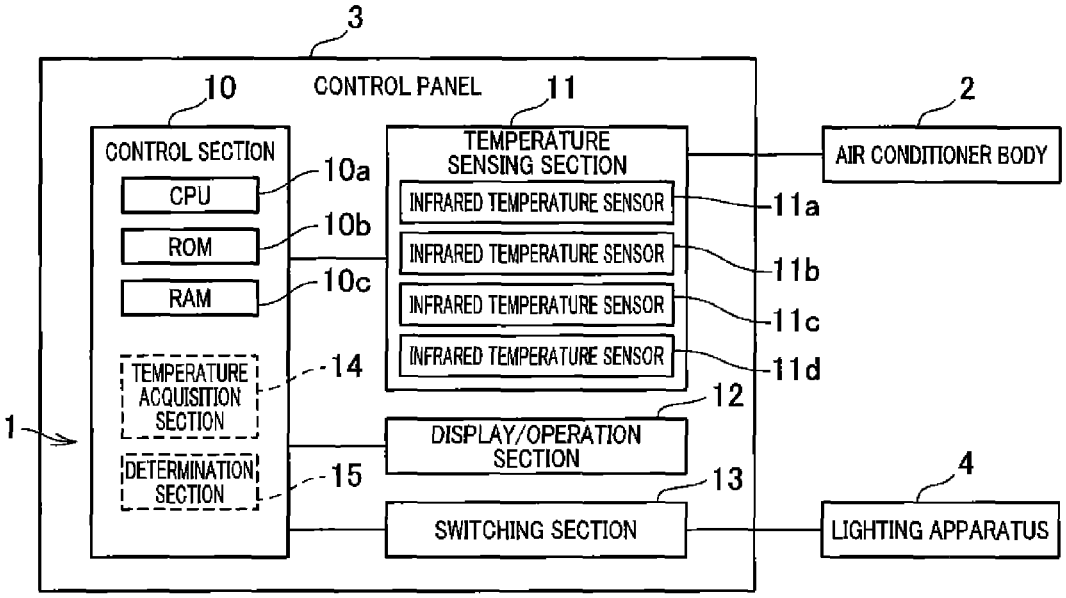
FIG. 3 is a schematic diagram illustrating an electrical configuration of the lighting control device.

As shown in FIG. 3, the lighting control device 1 includes a control section 10, temperature sensing section 11, a display/operation section 12, a switching section 13, a temperature acquisition section 14 and a determination section 15. The control section 10 is configured by a microcomputer that includes a central processing unit (CPU) 10*a*, a read only memory (ROM) 10*b* and a random access memory (RAM) 10*c*, and controls the entire lighting control device 1. The control section 10 also performs processes as the control panel 3 for the air-conditioning apparatus. The processes include giving a notification to the air conditioner body 2 regarding the temperature of the room 5 sensed by the temperature sensing section 11, the set temperature inputted from the display/operation section 12, and the like, or displaying the temperature of the room 5 on the display/operation section 12.

Figure 4:
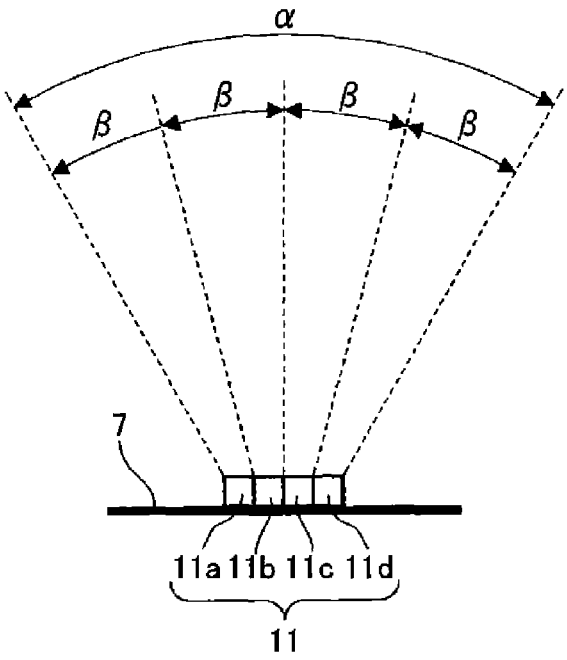
FIG. 4 is a schematic diagram illustrating a view angle of a temperature sensing section.

The temperature sensing section 11 is configured, in the present embodiment, by four infrared temperature sensors 11*a*, 11*b*, 11*c* and 11*d*. As shown in FIG. 4, the temperature sensing section 11 has an overall view angle α of a sensing area in which the more the sensing area expands, the more it departs from the main body of the temperature sensing section 11. The more the sensing area expands, the more it departs from the main body of the temperature sensing section 11. Each of the infrared temperature sensors 11*a*, 11*b*, 11*c* and 11*d* has a view angle β of a sensing area in which the more the sensing range expands further it is from the main body of the sensor. In the temperature sensing section 11, the infrared temperature sensors 11*a*, 11*b*, 11*c* and 11*d* are arranged such that their sensing areas are different from each other.

The expression that "their sensing areas are different from each other" herein does not mean that the sensing areas are not overlapped with each other, but means that "their sensing areas do not completely coincide". Specifically, the sensing areas may be partially overlapped between adjacent sensors. Also, the sensing area of a sensor A may be entirely included in the sensing area of a sensor B. In this case, since the sensing area of the sensor B is larger than that of the sensor A, the sensing areas are regarded as being different from each other. Further, the sensing areas may coincide with each other in the planar direction as shown in FIGS. 4 and 2 but may be different from each other in the height direction as shown in FIG. 1. In this case as well, the sensing areas are regarded as being different from each other.

The temperature sensing section 11 is formed into an external form of about 1 cm in size, and arranged with its sensing surface being exposed to the surface of the control panel 3. Accordingly, when the palm of the person M, for example, is put close to the control panel 3, the sensing area of the temperature sensing section 11 will be covered with the palm of the person M. The temperature sensing section 11 configures temperature sensing means together with the control section 10 and the like.

The display/operation section 12 includes a liquid crystal display (LCD), for example, and operation switches (none of them is shown). The display/operation section 12 displays the temperature of the room 5 sensed by the temperature sensing section 11 and receives operation inputs for setting a temperature. The display/operation section 12 is also included in an air-conditioning apparatus having a configuration based on the related art.

The switching section 13 switches the state of the lighting apparatus 4 from a turn-off state to a turn-on state, or vice versa. The specific configuration for performing switching of the lighting apparatus 4 may be set in accordance with the specification of the lighting apparatus 4, as needed. For example, the turn-on state and the turn-off state of the lighting apparatus 4 may be switched depending on the presence or absence of electric power supply. In this case, the switching section 13 may be configured to include a relay or the like so that the electric power supply for the lighting apparatus 4 is stopped or started. Alternatively, the turn-on state and the turn-off state of the lighting apparatus 4 may be switched by a contact signal that turns on the lighting apparatus 4 when an external contact is in an on state and turns off the same when the external contact is in an off state. In this case, the switching section 13 may be configured to include a relay or the like and the relay may be turned on/off to switch the state of the lighting apparatus 4 from a turn-off state to a turn-on state, or vice versa. Either way, a configuration conventionally used for controlling the lighting apparatus 4 may be used.

The temperature acquisition section 14 acquires, as a sensed temperature, the temperature sensed by the temperature sensing section 11, i.e. the temperature of the room 5 sensed by the infrared temperature sensors 11*a*, 11*b*, 11*c* and 11*d*. As is well known, the sensed temperature is used for conditioning the air of the room 5. In the present embodiment, the temperature acquisition section 14 acquires sensed temperatures of the infrared temperature sensors 11*a*, 11*b*, 11*c* and 11*d* on an individual basis (individual sensed temperature). As will be described later, the individual sensed temperatures are used for determining whether or not a switching operation has been performed. The temperature acquisition section 14 configures the temperature acquiring means together with the control section 10 and the like.

The determination section 15 determines whether or not the temperature of the room 5 sensed by the temperature sensing section 11 (sensed temperature) is within the temperature range set by the person M. As is well known, if the sensed temperature is out of the set temperature range, the determination section 15 activates the air conditioner body 2 so that the temperature of the room 5 falls within the set temperature range. Further, in the present embodiment, the determination section 15 determines whether or not all of the individual sensed temperatures that have been individually sensed by the infrared temperature sensors 11*a*, 11*b*, 11*c* and 11*d* coincide with a preset criterion temperature (palm criterion temperature that will be described later) within a preset tolerance range (acceptable error range). This determination corresponds to the determination as to whether or not a switching operation has been performed. The determination section 15 configures the determining means together with the control section 10 and the like.

As described above, the temperature acquisition section 14 and the determination section 15 of the lighting control device 1 correspond to the configuration originally included in an air-conditioning apparatus. At the same time, in the present embodiment, the temperature acquisition section 14 and the determination section 15 also correspond to the configuration for determining whether or not a switching operation has been performed.

Hereinafter, the effects of the above configuration will be described.

First, hereinafter is described how a switching operation is determined to have been performed (how the switching conditions are determined to have been met).

The lighting control device 1 determines that the switching conditions have been met when the individual sensed temperatures sensed by the four infrared temperature sensors 11*a*, 11*b*, 11*c* and 11*d* of the temperature sensing section 11 coincide, within the preset tolerance range, with the criterion temperature. In the present embodiment, the criterion temperature is set to the body temperature of the person M (in the present embodiment, the temperature of the palm that is an exposed portion of the person M). Hereinafter, the criterion temperature is referred to as palm criterion temperature, for the sake of convenience. In the present embodiment, the palm criterion temperature is set to 35° C. and the tolerance range is set to a range of the palm criterion temperature ±2° C.

Generally, the upper limit of the temperature set to an air-conditioning apparatus (set temperature) is about 30° C. Therefore, when the around-the-clock air conditioning as mentioned above is performed, it is quite unlikely that the temperature of the room 5 reaches near 35° C. In particular, the state where the individual sensed temperatures sensed by the four infrared temperature sensors 11*a*, 11*b*, 11*c* and 11*d* having a different sensing area all coincide with the palm criterion temperature may correspond to the situation in which the palm of the person M is put close to the temperature sensing section 11. Accordingly, when a temperature near 35° C. is sensed by the temperature sensing section 11, the lighting control device 1 determines that a switching operation has been performed.

Figure 5:
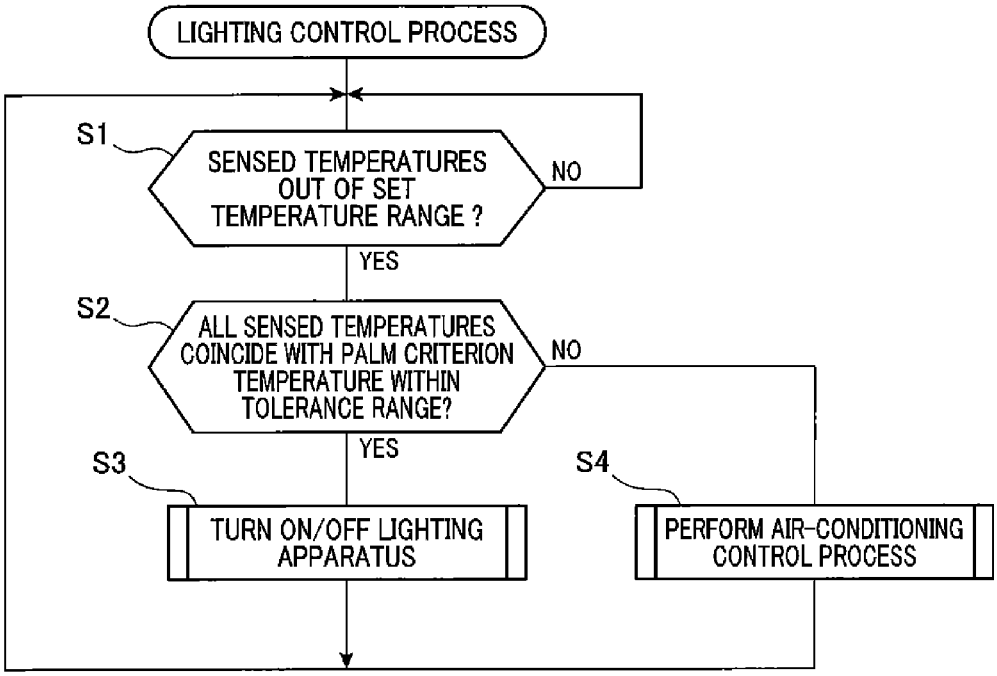
FIG. 5 is a flow diagram illustrating a lighting control process performed by the lighting control device.

Specifically, the lighting control device 1 performs a lighting control process shown in FIG. 5. As shown in FIG. 5, the lighting control device 1 determines whether or not the sensed temperatures sensed by the temperature sensing section 11 are not out of the set temperature range (step S1). If the sensed temperatures are not out of the set temperature range (NO at step S1), the mode of the lighting control device 1 turns to a standby mode. On the other hand, if the sensed temperatures are out of the set temperature range (YES at step S1), the lighting control device 1 determines whether or not all of the individual sensed temperatures sensed by the four infrared temperature sensors 11*a*, 11*b*, 11*c* and 11*d* coincide, within the tolerance range, with the criterion temperature (step S2).

In this case, if none of the sensed temperatures does not coincide, within the tolerance range, with the criterion temperature (NO at step S2), the air-conditioning control process is performed (step S4). The air-conditioning control process is performed to have the temperature of the room 5 coincided with the set temperature. For example, the air-conditioning control process is a well-known process in which a drive command is outputted to the air conditioner body 2.

Specifically, the lighting control device 1 performs a process, which is similar to the conventional one, of performing air conditioning because the temperature of the room 5 is not the set temperature. In other words, the lighting control device 1 adds a step of determining whether or not a switching operation has been performed (step S2), to the air-conditioning control process, without changing the flow of processings based on the related art.

Figure 6A:
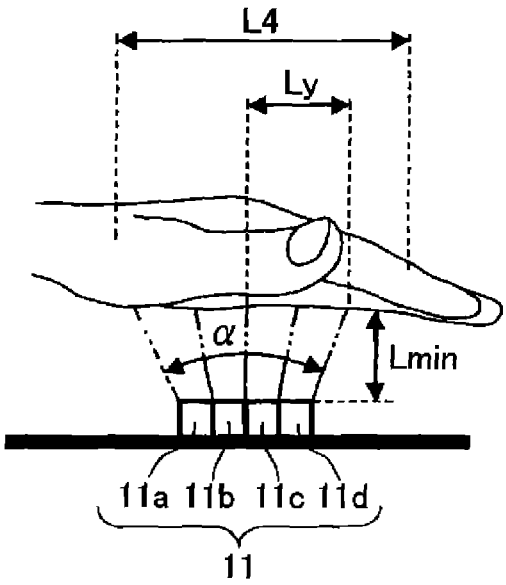
FIGS. 6A and 6B are schematic diagrams each illustrating a relationship between lower limit of a distance range and view angle of the temperature sensing section.

On the other hand, if all of the sensed temperatures coincide, within the tolerance range, with the criterion temperature (YES at step S2), the lighting control device 1 determines that the switching conditions have been met and turns on/off the lighting apparatus 4 (step S3). Specifically, at step S3, the lighting control device 1 controls the lighting apparatus 4 so as to be switched to a turn-off state if it is in a turn-on state currently, and switched to a turn-on state if it is in a turn-off state currently. As shown in FIG. 6A, the state where the switching conditions have been met indicates that the entire sensing areas of the four infrared temperature sensors 11*a*, 11*b*, 11*c* and 11*d* are covered with the palm of the person M. In other words, this state indicates that the person M has put his/her hand close to the lighting control device 1. Accordingly, in a situation as shown in FIG. 6A, the lighting control device 1 determines that a switching operation has been performed.

Figure 6B:
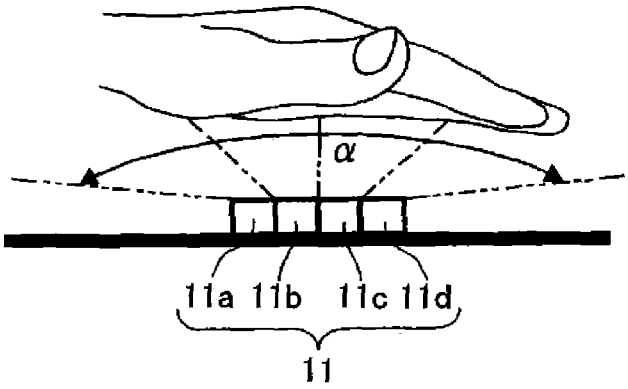

As shown in FIG. 6B, when the view angle α of the temperature sensing section 11 is near 180 degrees, all of the individual sensed temperatures will not necessarily coincide with the palm criterion temperature even when the hand of the person M is put close to the temperature sensing section 11. On the other hand, when the person M is away from the temperature sensing section 11, a switching operation would have been hardly conducted. Accordingly, in this case, it is required that no erroneous determination is ensured to be made.

In this regard, the lighting control device 1 defines a relation between a distance based on which a switching operation is determined to have been performed, and the view angle α of the temperature sensing section 11.

First, a distance (L3) based on which no erroneous determination will be made is described.

Figure 7:
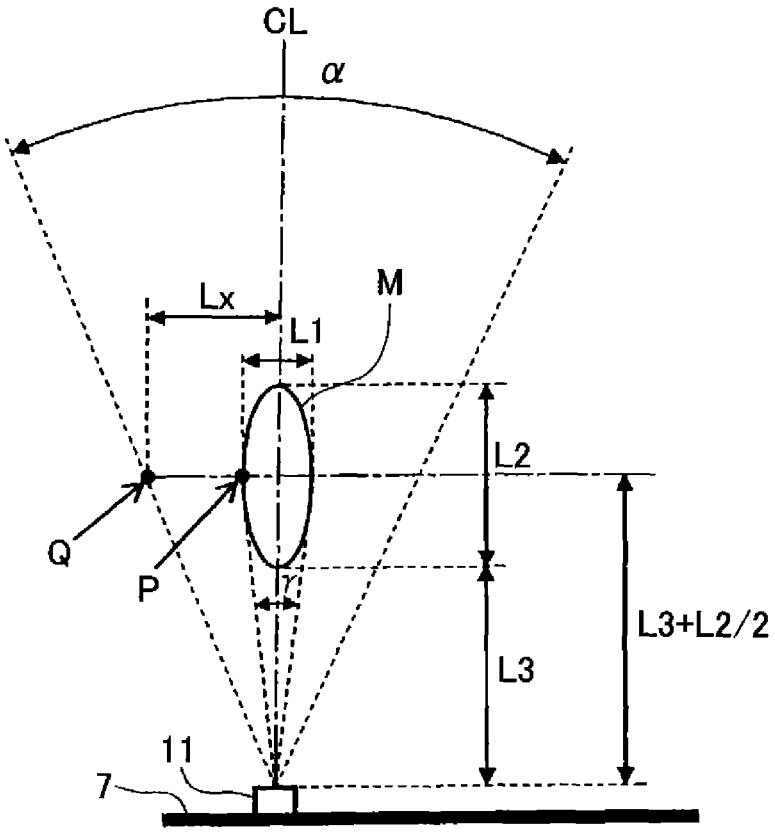
FIG. 7 is a schematic diagram illustrating a relationship between distance to a person and view angle of the temperature sensing section.

Here, the distance causing no erroneous determination is L3. For example, as shown in FIG. 7, when the person M cuts across in front of the temperature sensing section 11, the view angle α is interrupted by the person M. The person M in this case is positioned on an imaginary center line CL. When the view angle α of the temperature sensing section 11 is larger than an angle γ corresponding to a point P on an outermost edge of the person M, the view angle α will not be entirely interrupted. In other words, in order to prevent the interruption of the entire view angle α in a situation as shown in FIG. 7, a point Q corresponding to an outermost edge of the view angle α only has to be positioned outside (on the left, in the figure, of) the point P.

In this case, when the thickness (chest depth) of the person M is L1 and the width (shoulder length) of the person M is L2, the distance from the center line CL to the point P is L1/2. Accordingly, when the distance from the center line CL to the point Q is Lx, the following formula (1) is established:

$$Lx > L1/2 \quad (1)$$

When the distance from the temperature sensing section 11 to the person M is L3, the following formula (2) is established:

$$\tan(\alpha/2) = Lx/(L3+L2/2) \quad (2)$$

Accordingly, the following formula (3) is derived:

$$Lx=\tan(\alpha/2)\times(L3+L2/2) \quad (3)$$

Then, from formulas (1) and (3), a relation expressed by the following formula (4) is derived:

$$\tan(\alpha/2)\times(L3+L2/2)>L1/2 \quad (4)$$

As a result, a relation expressed by the following formula (5) is derived:

$$\alpha/2>\tan^{-1}((L1/2)/(L3+L2/2)) \quad (5)$$

That is, a relation expressed by the following formula (6) is derived:

$$\alpha>2\times\tan^{-1}((L1/2)/(L3+L2/2)) \quad (6)$$

Based on formula (6), a lower limit of the view angle α at the distance L3 can be calculated. In other words, if only the view angle α of the temperature sensing section 11 is set so as to satisfy formula (6), an erroneous determination is ensured not to be made if the person M cuts across in front of the temperature sensing section 11 at the distance L3 (e.g., L3=20 cm). More specifically, the distance L3 is the lower-limit distance at which the person M will not be erroneously detected in the case of using the temperature sensing section 11 with the view angle α. The numerical values of the thickness L1 and the width L2 of the person M may be set on the basis of statistical numerical values or the like, as needed.

Hereinafter is described a lower-limit distance (Lmin) of a detectable range that is a range enabling a determination that a switching operation has been performed.

The lower limit of the sensing area here is Lmin. Here, it may be ensured that the palm (with a width L4) of the person M entirely interrupts the view angle α when the palm is positioned at the distance Lmin. In other words, it may be ensured that a situation as shown in FIG. 6B does not occur.

As shown in FIG. 6A, the center of the palm is positioned at the center of the view angle α. When the length from the center of the palm to the outermost edge of the view angle α at the distance Lmin is Ly, the following relation expressed by formula (7) may have to be established:

$$Ly<L4/2 \quad (7)$$

Through a calculation that uses a derivation process similar to the one used in deriving formula (6), the following formula (8) is obtained:

$$Ly/Lmin=\tan(\alpha/2) \quad (8)$$

Based on formulas (7) and (8), a relation expressed by the following formula (9) is derived:

$$Lmin\times\tan(\alpha/2)<L4/2 \quad (9)$$

Accordingly, finally, a relation expressed by the following formula (10) is derived:

$$2\times\tan^{-1}((L4/2)/Lmin)>\alpha \quad (10)$$

Based on formula (10), the upper limit of the view angle α of the temperature sensing section 11 is calculated in the case of setting a lower-limit distance of the detectable range to Lmin. Specifically, for example, Lmin here is set to 1 cm. In order to determine that the palm has been put over the temperature sensing section 11 at a position distanced therefrom by 1 cm, it will be understood that the view angle α of the temperature sensing section 11 satisfying formula (10) may only have to be used. In this case, the numerical value of the width L4 of the palm may be set on the basis of statistical numerical values or the like, as needed.

Formula (6) provided above is in relation to a distance that will not cause erroneous detection of the person M. Alternative to this, an upper-limit distance of the detectable range may be defined. Here, an upper-limit distance of the sensing area is Lmax. At the distance Lmax as well, the palm (with a width L4) may be ensured to entirely interrupt the view angle α of the temperature sensing section 11. The relation between the distance Lmax and the view angle α can be derived in a manner similar to formula (10) provided above, as expressed by the following formula (11):

$$2\times\tan^{-1}((L4/2)/Lmax)<\alpha \quad (11)$$

Based on formulas (10) and (11), a relation expressed by the following formula (12) is derived:

$$2\times\tan^{-1}((L4/2)/Lmax)<\alpha<2\times\tan^{-1}((L4/2)/Lmin) \quad (12)$$

Specifically, when the temperature sensing section 11 having the view angle α is used, Lmax and Lmin satisfying the relation of formula (12) are the upper and lower limits, respectively, of the detectable range. For example, Lmax and Lmin may be set to 5 cm and 1 cm, respectively. In this case, the lighting control device 1 determines that a switching operation has been performed when the hand of the person M is put over the temperature sensing section 11 at a position that falls within a range of 1 cm to 5 cm. In the event that the upper-limit distance Lmax of the sensing area exceeds the distance L3 for not causing an erroneous determination, priority may be given to either one of Lmax and L3 when the lighting control device 1 is designed, and then the view angle α may be set accordingly, as needed.

In this way, if all of the temperatures sensed in the temperature sensing section 11 coincide, within the tolerance range, with the palm criterion temperature, the lighting control device 1 determines that a switching operation has been performed. Then, the lighting control device 1 controls the state of the lighting apparatus 4 so as to be switched from a turn-off state to a turn-on state, or vice versa.

The embodiment described above has advantages as provided below.

The lighting control device 1 determines whether the switching conditions have been met, on the basis of the temperatures sensed by the temperature sensing section 11 that has conventionally been included in an air-conditioning apparatus. Therefore, a configuration for detecting a person is not required to be newly added, for the purpose of controlling the lighting apparatus 4. Specifically, the control panel 3 for controlling the air conditioner body 2 can also be used for controlling the lighting apparatus 4. Accordingly, a switch dedicated to the lighting control apparatus 4 is not required to be separately provided. More specifically, the lighting control device 1 is able to switch the state of the lighting apparatus 4 from a turn-off state to a turn-on state, or vice versa, using the control panel 3, as it is, of the air conditioner body 2, the control panel 3 essentially having a configuration based on the related art. In this manner, the total cost of the lighting control device 1 can be reduced.

The logic of acquiring temperatures and the logic such as of determining whether the acquired temperatures are out of a set temperature range are the logic has conventionally been used. The lighting control device 1 has additional steps (steps S2) of determining whether all of the individual sensed temperatures coincide with the criterion temperature. Therefore, it is not necessary to construct all over again a new logic (e.g., method or algorithm) of controlling the lighting apparatus 4. Sensing of temperatures by the temperature sensing section 11 and determination as to whether the sensed temperatures coincide with a set temperature are what has been performed conventionally. Accordingly, there are no additional processes that would increase the loads of the lighting control device 1.

As described above, the lighting control device 1 enables integration of the switch of the lighting apparatus 4 into the control panel 3 of the air-conditioning apparatus, without greatly increasing the manufacturing cost. Accordingly, the control means can be arranged at a position at which a user can easily manipulate it to thereby enhance the usability. Further, the lighting control device 1 can reduce the number of parts arranged on the wall 7 and thus can easily achieve harmonization with the interior design of the room, thereby enhancing the satisfaction level of the person M.

The lighting control device 1 is formed such that the sensing area of the temperature sensing section 11 expands in a direction of departing from the temperature sensing section 11. Thus, a situation in which the sensing area is entirely interrupted by the person M is created only when the person M is present at a position near the temperature sensing section 11. In other words, the temperatures sensed by the temperature sensing section 11 coincide with the criterion temperature only when the person M is present at a position near the temperature sensing section 11. Accordingly, the person M positioned away from the temperature sensing section 11 will not trigger a determination that the switching operation has been performed, thereby preventing an erroneous determination that the switching operation has been performed.

In the lighting control device 1, the temperature sensing section 11 is configured by arranging the plurality of infrared temperature sensors 11*a*, 11*b*, 11*c* and 11*d* whose sensing areas expand in a direction of departing from the sensors. The temperature sensors 11*a*, 11*b*, 11*c* and 11*d* are arranged such that the sensing areas will be different from each other. The infrared temperature sensors 11*a*, 11*b*, 11*c* and 11*d* individually sense temperatures. When all of the individual sensed temperatures coincide with the criterion temperature, the switching conditions are determined as having been met. In this case, it is only when the person M is positioned near the temperature sensing section 11 that all of the individual sensed temperatures sensed by the infrared temperature sensors 11*a*, 11*b*, 11*c* and 11*d* coincide with the criterion temperature. Thus, in making a determination whether or not a switching operation has been performed, an erroneous determination is prevented from being made.

The lighting control device 1 sets the temperature of the palm of the person M as a criterion temperature. The temperature of the palm of the person M is considered to be about 35° C. to 36° C. On the other hand, the temperature set at an air-conditioning apparatus is generally about 30° C. at most. In other words, there is a large difference between the temperature of the palm and the set temperature of the air-conditioning apparatus. Accordingly, the probability of making an erroneous determination is reduced.

When the person M is going to operate the lighting apparatus 4, generally, the person M will put his/her palm over the temperature sensing section 11. Therefore, sensing the temperature of the palm corroborates that the palm has been placed near the temperature sensing section 11, i.e. that a switching operation has been performed. Thus, the degree of certainty is enhanced in determining a switching operation as having been performed.

The view angle α of the temperature sensing means, the thickness L1 of the person M, the width L2 of the person M and the distance L3 between the person M and the temperature sensing means satisfy a relation expressed by the following formula:

$$\alpha > 2\times\tan^{-1}((L1/2)/(L3+L2/2))$$

Therefore, when the person M passes across the position of the distance L3, the sensing area will not be entirely interrupted by the person M. Accordingly, the crossing of the person M will not cause an erroneous determination that a switching operation has been performed.

The upper and lower limits Lmax and Lmin of the detectable range, the view angle α of the temperature sensing means and the width L4 of the palm are ensured to satisfy a relation as expressed by the following formula:

$$2\times\tan^{-1}((L4/2)/Lmax) < \alpha < 2\times\tan^{-1}((L4/2)/Lmin)$$

As shown in FIG. 6B, when the sensing area of the temperature sensing section 11 has an angle near 180 degrees, the entire sensing area will not be necessarily covered with the palm when the palm is put near the temperature sensing section 11. In this case, when a switching operation is performed, the switching operation will not be necessarily detected. In this regard, when the upper and lower limits of the sensing area, the view angle α of the temperature sensing means and the width of the palm are ensured to satisfy the formula set forth above, the entire sensing area is ensured to be interrupted by the palm in a distance ranging from the distance Lmin to the distance Lmax. Thus, a reliable determination can be made as to whether a switching operation has been performed.

(Modifications)

The present invention is not limited to the embodiment described above but may be modified or extended as set forth below.

In the embodiment described above, the electrical power for the lighting apparatus 4 is switched on/off to change the state of the lighting apparatus 4 from a turn-off state to a turn-on state, or vice versa. Alternative to this, the switching section 13 may send information, such as a turn-on command or a turn-off command, to the lighting apparatus 4 to change the state of the lighting apparatus 4 from a turn-off state to a turn-on state, or vice versa. Alternatively, the switching section 13 and the lighting apparatus 4 may be connected in a manner of performing wireless communication, so that the information, such as a turn-on command or a turn-off command, can be given on the basis of wireless communication. In other words, the switching section 13 may only have to be configured such that the state of the lighting apparatus 4 can be changed from a turn-off state to a turn-on state, or vice versa. Thus, the configuration of the switching section 13 can be selected as needed.

As an application example, the switching section 13 may be further configured to switch on and off an electrical (or electronic) apparatus (or device or equipment) other than the lighting apparatus 4, for example, a television receiver, provided in the room 5 in which the air-conditioning apparatus 2 is provided, in addition to or instead of the lighting apparatus 4, as needed. In this case, as a switching condition for switching on and off the electrical apparatus, the switching condition of the lighting apparatus 4 as described above may be applied. This electrical apparatus can be switched on and off, using the control panel 3 of the air-conditioning apparatus 2, without the necessity of constructing or adding a new sensing element, sensing logic or the like. This makes it possible to greatly enhance usability without greatly increasing the cost and loads of the apparatus, and also makes it possible to easily harmonize with the interior design of the room.

In the embodiment described above, the width L4 of the palm is used for defining the upper and lower limits of the sensing area. Alternatively, the height direction as shown in FIGS. 1 and 2 (crosswise direction of the palm, i.e. direction vertical to the drawing paper in the illustration of FIG. 6, that is, a direction from the thumb toward the little finger) may also be taken into account. In this case, the area of the palm is La and the cross-sectional area of the sensing area at the distance Lmin (area of the sensing area on a plane opposed to the temperature sensing section 11) is Lb. The cross-sectional area Lb may be ensured to be smaller than the area La of the palm to thereby define the lower limit of the sensing area. Further, the upper limit of the detectable range as indicated by the distance Lmax may also be defined by the cross-sectional area Lb of the sensing area.

Other than the temperature of the palm as in the embodiment described above, the criterion temperature may be set to the temperature of other exposed portions of a person. For example, the criterion temperature may be the temperature of the back of the hand, the temperature of the face, or the like.

What is claimed is:

1. A lighting control device for controlling a turn-on state and a turn-off state of a lighting apparatus provided in a room in which an air-conditioning apparatus is provided, the lighting control device comprising:

temperature sensing means that is provided in the air-conditioning apparatus and senses temperature of the room to allow the air-conditioning apparatus to perform air-conditioning control such that the temperature of the room sensed by the temperature sensing means lies within a preset temperature range;

temperature acquisition means that acquires, as a sensed temperature, the temperature sensed by the temperature sensing means;

determination means for determining that a switching condition for switching the lighting apparatus between a turn-on state and a turn-off state has been met, when the sensed temperature acquired by temperature acquisition means coincides, within a preset tolerance range, with a criterion temperature which is set separately from the preset temperature range on the basis of a body temperature of a person; and switching means for switching the lighting apparatus between the turn-on state and the turn-off state, when the determination means determines that the switching condition has been met.

2. The lighting control device according to claim 1, wherein the temperature sensing means is formed such that the more a sensing area of the temperature sensing means expands, the more the sensing area departs from the temperature sensing means.

3. The lighting control device according to claim 2, wherein:

the temperature sensing means includes a plurality of infrared temperature sensors having a sensing area which is formed such that the more sensing area departs from each of the infrared temperature sensors the more the sensing area of each of the infrared expands, the infrared temperature sensors being arranged such that their sensing areas are different from one another;

the temperature acquisition means further acquires individual sensed temperatures which are temperatures individually sensed by the infrared temperature sensors; and the determination means determines that the switching condition has been met when all of the individual sensed temperatures acquired by the temperature acquisition means coincide with the preset criterion temperature within the tolerance range.

4. The lighting control device according to claim 3, wherein the criterion temperature is set to a temperature of an exposed portion of a person.

5. The lighting control device according to claim 4, wherein:

the temperature sensing means is formed such that the further a sensing area is from the temperature sensing means the more the sensing area expands; and the temperature sensing means satisfies a relation expressed by the following formula:

$$\alpha>2\times\tan^{-1}((L1/2)/(L3+L2/2))$$

where $\alpha$ is a view angle of the temperature sensing means, L1 is a thickness of a person, L2 is a width of the person and L3 is a distance between the person and the temperature sensing means.

6. The lighting control device according to claim 1, wherein:

the temperature sensing means includes a plurality of infrared temperature sensors having a sensing area which is formed such that the more sensing area departs from each of the infrared temperature sensors the more the sensing area of each of the infrared expands, the infrared temperature sensors being arranged such that their sensing areas are different from one another;

the temperature acquisition means further acquires individual sensed temperatures which are temperatures individually sensed by the infrared temperature sensors; and the determination means determines that the switching condition has been met when all of the individual sensed temperatures acquired by the temperature acquisition means coincide with the preset criterion temperature within the tolerance range.

7. The lighting control device according to claim 1, wherein the criterion temperature is set to a temperature of an exposed portion of a person.

8. The lighting control device according to claim 1, wherein:

the temperature sensing means is formed such that the further a sensing area is from the temperature sensing means the more the sensing area expands; and the temperature sensing means satisfies a relation expressed by the following formula:

$$\alpha>2\times\tan^{-1}((L1/2)/(L3+L2/2))$$

where $\alpha$ is a view angle of the temperature sensing means, L1 is a thickness of a person, L2 is a width of the person and L3 is a distance between the person and the temperature sensing means.

9. The lighting control device according to claim 1, wherein:

the temperature sensing means is formed such that the further a sensing area is from the temperature sensing means the more the sensing area expands; and the temperature sensing means satisfies a relation expressed by the following formula:

$$2\times\tan^{-1}((L4/2)/Lmax)<\alpha<2\times\tan^{-1}((L4/2)/Lmin)$$

where $\alpha$ is view angle of the temperature sensing means, L4 is a width of a palm of a person, and Lmax and Lmin are an upper and lower limits of a detectable range of the temperature sensing means.

10. An electrical device, comprising:

an air-conditioning apparatus provided in the room;

a lighting apparatus provided in a room; and a lighting control device for controlling a turn-on state and a turn-off state of the lighting apparatus, wherein the lighting control device comprises:

temperature sensing means that is provided in the air-conditioning apparatus and senses temperature of the room to allow the air-conditioning apparatus to perform air-conditioning control such that the temperature of the room sensed by the temperature sensing means lies within a preset temperature range;

temperature acquisition means that acquires, as a sensed temperature, the temperature sensed by the temperature sensing means;

determination means for determining that a switching condition for switching the lighting apparatus between a turn-on state and a turn-off state has been met, when the sensed temperature acquired by temperature acquisition means coincides, within a preset tolerance range, with a criterion temperature which is set separately from the preset temperature range on the basis of a body temperature of a person; and switching means for switching the lighting apparatus between the turn-on state and the turn-off state, when the determination means determines that the switching condition has been met.

11. The electrical device according to claim 10, wherein:

the air-conditioning apparatus includes a control panel; and the lighting control device is provided in the control panel.

12. The electrical device according to claim 11, wherein:

the control panel is arranged on a wall of the room.

* * * * *